United States Patent [19]

Lark

[11] 4,035,531

[45] July 12, 1977

[54] PROCESS FOR WARP SIZING AND HYDROPHILIC FINISHING OF POLYESTER FILAMENTS AND FABRIC

[75] Inventor: John C. Lark, St. Charles, Ill.

[73] Assignee: Standard Oil Company (Indiana), Chicago, Ill.

[21] Appl. No.: 582,356

[22] Filed: May 30, 1975

[51] Int. Cl.[2] ..... B05D 3/02

[52] U.S. Cl. ..... 427/390 R; 260/75 R; 260/75 S; 260/75 T; 260/485 G; 428/290; 428/394; 428/395; 428/483

[58] Field of Search ..... 260/75 R, 75 S, 75 T, 260/485 G; 427/390 R; 428/290, 394, 395, 483

[56] References Cited

U.S. PATENT DOCUMENTS

| | | | |
|---|---|---|---|
| 3,136,655 | 6/1964 | Wolinski | 260/75 X |
| 3,236,685 | 2/1966 | Caldwell et al. | 428/394 X |
| 3,350,331 | 10/1967 | Liebling et al. | 260/75 X |
| 3,734,874 | 5/1973 | Kibler et al. | 260/75 X |
| 3,779,993 | 12/1973 | Kibler et al. | 260/75 S |
| 3,853,820 | 12/1974 | Vachon | 260/75 T |

*Primary Examiner*—Michael H. Lusignan
*Attorney, Agent, or Firm*—William C. Clarke; Arthur G. Gilkes; William T. McClain

[57] ABSTRACT

A process of warp sizing polyester filaments and hydrophilic finishing polyester fabrics which comprises (1) coating said polyester with the water-soluble polyester of a dihydric alcohol having two to six carbon atoms and an aromatic polycarboxylic acid compound having three, four or five carboxy groups and (2) drying said polyester onto said filament or (3) curing said polyester onto said fabric.

10 Claims, No Drawings

PROCESS FOR WARP SIZING AND HYDROPHILIC FINISHING OF POLYESTER FILAMENTS AND FABRIC

BACKGROUND OF THE INVENTION

The field of this invention has two aspects. The first aspect relates to a filament coating process to coat polyester filaments so as to protect the warp yarn from abrasive forces during weaving by means of a warp size. The second aspect relates to a fabric coating process, which is a modification of the filament coating process, to modify the surface properties of polyester fibers and fabrics so as to improve their hydrophilic characteristics with consequent improvement in antisoiling and antistatic properties under standard laundering conditions.

The general object of this invention is to provide a simple process of warp sizing 100% polyester filament. Another object is to provide a simple process of treating 100% polyester fibers and fabrics so as to improve the hydrophilic properties of these fibers. Another object is to obtain these improved properties with minimum modification of the hand of the material. Another object is to provide a process which utilizes the treating additive at a low level of application, thus obtaining an economic, efficient rate of use of the treating additive. Other objects appear hereinafter.

In the first aspect of this invention, in the production of woven fabrics, it is usually necessary to apply a suitable material to the warp yarns so that they may be adequately protected during weaving. The process by which the protective material is applied to the warp yarns is known as warp sizing. The function of the warp size is to protect the warp yarn from the tremendous forces of abrasion encountered during weaving. The warp size is required to be a readily-removable, film-forming adhesive polymer.

The adhesive film-forming materials used as sizing materials are usually polymers which are either water-soluble or may be easily solubilized with a mild alkali. The traditional size for warp sizes have been polysaccharides such as starches, proteins such as gelatin and casein, and vinyl polymers such as polyvinyl alcohol, polyacrylic acid and water-soluble acidic vinyl copolymers. However, materials of this type do not demonstrate the adhesion to 100% polyester filament necessary to provide the protection through the weaving process. The characteristics desired of a good warp size for 100% polyester filament are good abrasion resistance, good film flexibility, adhesion to the fiber, lack of sensitivity to atmospheric moisture and ease of removal. Therefore a need exists for a warp size composition which avoids the above disadvantage of adherence to 100% polyester filament.

I have now found that the process of coating 100% polyester filament with a low molecular weight high acid number polyester resin based on a dihydric alcohol having two to six carbon atoms and an acid having 3 to 5 carboxy groups protects the warp yarn from abrasive forces during weaving by functioning as a warp size. The preferred polyester of this invention is a trimellitic anhydride-neopentyl glycol polyester because of the absence of tack of this polyester.

The second aspect of this invention relates to the fact that many synthetic polymers such as polyesters, polyamides and polyolefins which are utilized as fibers suffer from the problem that they are relatively hydrophobic, that is, they lack an affinity for water and are relatively unable to either absorb or transport moisture along the surface of the fiber. This characteristic of hydrophobicity has been a persistent problem in the utilization of these synthetic fibers for garments. For example, a hydrophilic surface, i.e., a surface having a strong affinity for water, is particularly important in garments such as shirts and undergarments where rapid transmission of moisture is an asset. Hydrophobic fibers, if used for such garments, cause a cold, clammy feeling and a degree of discomfort to the wearer. Lack of moisture transmission also results in lack of breathing of the fabric which is attended by the wearer's tendency to assume the fabric is harsh and hard on the skin.

Hydrophobic properties of a fiber are also well-known as affecting its antistatic and antisoiling properties. Hydrophobic fibers when formed into shaped textile articles tend to accumulate static charges with a propensity to accept and retain grime and dirt. Synthetic hydrophobic fibers also tend to be oleophilic. Therefore, should oil and grime become embedded in the fiber, its hydrophobic properties tend to prevent water from entering the fiber to remove the contaminates therefrom. The difficult problem of cleaning oleophilic fibers makes desirable the modification of these properties to permit entrance of water for ease of cleaning.

A substantial amount of research has been performed in the textile industry to overcome the problem of the hydrophobic nature of these fibers by modifying their surface properties with a durable hydrophilic finish with attendant improvement in antistatic and antisoiling characteristics.

An example of a textile hydrophilic treatment process which functions by applying a polymeric coating is found in U.S. Pat. No. 3,236,685 to Caldwell et al. The polymeric coating adheres to the fiber by cross-linking a high molecular coating which provides a structured composition with an insoluble exterior that has the desired hydrophilic properties under conditions of wearing and laundering. The process described in this patent provides a hydrophilic insoluble coating having antistatic and antisoiling properties by coating the fabric with a solution or solutions containing a polyhydric alcohol and addition polymers of $\alpha$, $\beta$-ethylenically-unsaturated acids. Under the proper conditions, the polyhydric alcohol reacts with the aliphatic polyacid to partially cross-link the polymer to provide an external coating of the fiber. The patentee states that ester linkages are formed to provide a partially cross-linked, flexible polymeric material which functions very much as an ion exchange resin. The polymeric polybasic acid is cross-linked to the extent that it is no longer soluble but some of the acidic ions are available to furnish ions for conducting static charges. The esterification is necessary to provide an insoluble coating with durability to standard laundering conditions. The patentee states the hand of the fabric is affected by the amount of the polymeric additive applied so a minimum amount consistent with effective surface characteristics is desirable.

Another example of a textile treatment process which improves the antistatic and water-absorption properties of the fiber is found in British Pat. Specification No. 1,358,195 to Brokmeier et al. This process modifies the polymer composition to attain the desired properties. Acrylonitrile polymer compositions are rendered antistatic and hydrophilic by the incorporation within the polymer composition of antistatic compounds which are miscible in polyacrylonitrile spinning solutions. This system imposes an added requirement on the spinning solution, that it be miscible with the antistatic compound. The additives are processed into the fibers and as much as 20% by weight of the polymer is additive.

The second aspect of this invented process therefore is to provide a new approach to this problem of modifying the hydrophobic properties of fibers to improve their hydrophilic, antistatic and antisoiling characteristics which permit the avoidance of the defects in the present methods used. As mentioned, the cross-linking polymeric approach can affect the hand of the material if more than minimum quantities are used. The incorporation of the surface modifying additive into the polymer through the spinning solution as in British Pat. Specification No. 1,358,195 requires that the additive be miscible with the spinning solution. The British Patent Specification states that quantities of additive up to 20% of the polymer weight are to be utilized, which represents a relatively large use of additive.

I have now found, in reference to the second aspect of this invented process, that the process of coating fabrics composed of 100% polyester filament fiber and yarn with a low molecular weight high acid number polyester resin based on a dihydric alcohol having two to six carbon atoms and an acid having 3 to 5 carboxy groups and curing said resin onto the polyester filament fiber and yarn improves the hydrophilic properties of these fibers. These esters cure onto the polyester fiber surfaces during a cure cycle to give a hydrophilic, antistatic, antisoiling textile finish. The modification of these surface properties occurs without excessive impairment of the critical properties of the coated fabric such as hand. The treating additive is applied at a low level, representing an economic, efficient rate of use. The preferred polyester of this invention is a trimellitic anhydride-propylene glycol polyester because of the durability of the hydrophilic finish.

SUMMARY OF INVENTION

Polyester filament and fabric coating process protects warp yarn during weaving by means of a warp size and improves the hydrophilic, antistatic and antisoiling properties of fabrics made of 100% polyester fibers. The water-soluble polyester resin of a dihydric alcohol having two to six carbon atoms and an aromatic polycarboxylic acid compound having three to five carboxy groups is used. The polyester resins act as warp sizes when coated onto polyester filaments. The resins are cured onto the fiber surfaces to give a hydrophilic textile finish under standard laundering conditions.

DESCRIPTION OF THE PREFERRED EMBODIMENTS

It has been found, in accordance with this invention, that the process of coating 100% polyester filaments with water-soluble low molecular weight high acid number polyesters of a dihydric alcohol having 2 to 6 carbon atoms and an aromatic polycarboxylic acid compound having 3 to 5 carboxy groups provides a warp size to protect the warp yarn during weaving or improves the hydrophilic properties of the fabric. The preferred polyester is a trimellitic anhydride (TMA)-neopentyl glycol polyester for warp sizing. The preferred polyester to improve the hydrophilic properties of polyester fabric is a trimellitic anhydride-propylene glycol polyester.

Polyester fabrics are well-known textile fibers and textiles. For purposes of this invention, the term "polyester" is defined as including the highly-polymeric fiber and film-forming linear polyesters derived from at least one aliphatic, cycloaliphatic or aromatic dicarboxylic acid and at least one aliphatic, cycloaliphatic or aromatic diol. For purposes of this invention, the term "glycol" is defined as a dihydric alcohol with up to six aliphatic carbon atoms. Cyclo or ring compounds with aliphatic side chains are included. Examples of glycols include dipropylene glycol, diethylene glycol, ethylene glycol, propylene glycol, and neopentyl glycol. As is well-known, the lower molecular weight glycols are hydroscopic and have hydrophilic characteristics. The term "aromatic polycarboxylic acid compound" is defined as an unsaturated cyclic hydrocarbon compound containing one or more benzene rings to which three to five carboxylic acid groups or their acid anhydrides are attached directly to the aromatic ring moiety.

For purposes of this invention, the term "low molecular weight polyester" is defined as the ester of a low-molecular weight glycol and a polycarboxylic acid wherein the molecular weight of the polyester is no more than 3000. Preferably the molecular weight range is of the order of 1600. The term "high acid number" is defined as an acid number within the range from 160 to 320 where the acid number is further defined as milligrams of KOH per gram of sample.

For purposes of this invention, "tack" is defined as the property of an adhesive that enables it to form a bond of measurable strength immediately after adhesive and adherend are brought into contact at low pressure. The term "non-tack" is defined as the absence of tack or stickiness or the tendency to adhere.

The high acid number of the low molecular weight polyester is obtained by reacting the polycarboxylic acid compound, i.e., the trimellitic acid or its anhydride, in a mole ratio where the ratio of acid to glycol is greater than unity. The preferred ratio of TMA to glycol for a warp size is 1.2 to 1.0, i.e., where the ratio of carboxyl groups to hydroxyl groups is 3.6 to 2.

It is essential that the low molecular weight water-soluble polyester used for warp sizing be the polyester of a dihydric alcohol having two to six carbon atoms and an aromatic polycarboxylic acid compound having three to five carboxy groups. Preferably the glycol is neopentyl and preferably the acid compound is trimellitic anhydride because of the absence of tack. It is theorized that the geminal-dimethyl configuration of neopentyl glycol and the consequent absence of $\beta$-hydrogen which imparts exceptional hydrolytic stability to derivatives of this glycol act to provide the non-tackiness desired in warp size. The preferred add-on level is 4 to 8% of the filament weight.

Characteristics of a warp size for 100% polyester filament are that it dry to a hard non-tacky surface at ambient temperatures (20°–25° C), that it be non-blocking (very low moisture regain after conditioning at high relative humidity), have good adhesion to the polyester substrate, and demonstrate ease of removal at 70° C (160° F) with a 1% sodium carbonate solution.

The measurement of tack is made at the tack temperature which is defined as the lowest temperature at which two films of polymers in contact will just fuse under a pressure of 20 pounds per square inch which is applied for 2 seconds. (A. D. MacLaren et al., *J. Poly-*

*mer Sci*,. 7, 463, (1951)) The absence of tack is demonstrated by touch.

The absence of tack embodied in a hard, non-tacky surface at ambient temperatures was determined by two different methods. Solutions of the ammonium salt of the low molecular weight TMA/glycol ester in water were prepared. The solutions were 30 and 5% ester. Films were cast on both a one mil and a five mil polyester film substrate and tested as to tack after the films were air-dried. First, the air-dried film was tested by touch for stickiness. The surface of the film was touched by an oil-free finger which had been washed in acetone to remove skin oils. Second, the two cast films on polyester film were conditioned for 20–24 hours in a humidity chamber at 55–65% relative humidity (RH). After the conditioning, the samples were again tested for tack with the oil-free finger. Two of the conditioned films were placed face to face under a 200 gram weight. After two hours, the sample was peeled apart to ascertain if any adhesion (blocking) tendency or tack existed between the two films.

Adhesion of the cast films to the polyester substrate was tested by bending the films in several 180° bends on the polyester substrate in both "inside" and "outside" configurations. The creases were then examined for cracking and/or peeling from the polyester base. After the visual examination, the films were severely crumpled with a harsh grinding motion until the sample resembled a badly crushed sheet of paper. Again, visual examinations were made to determine if any cracking and/or peeling had occurred.

Ease of removal was determined upon an oven-dried sample. An air-dried sample was further dried in a forced air oven at a temperature of 120° C for a period of 10 minutes. The resulting film was immersed in a stirred 1% sodium carbonate water solution which was maintained at 70° C (160° F). The test TMA/glycol polyester film was removed in 1 minute.

In regards to the second aspect of this invented process, it is essential that the low molecular weight polyester resin used for hydrophilic treatment of 100% polyester fiber and fabric have an acid number of at least 160. It is essential that the polycarboxylic acid compound have at least three carboxyl groups to obtain the high acid number resin. Examples of the polycarboxylic acid compounds which are suitable for the polyester required for hydrophilic, antisoiling and antistatic treatment of 100% polyester fiber and fabric are, among others, trimellitic acid, trimesic acid, pyromellitic acid, mellophonic acid, prehnitic acid, etc., and anhydrides of these acids. These polycarboxylic acid compounds can be substituted with halogen and other radicals without impairing the hydrophilic and soil release properties of the fabric coating. The TMA/propylene glycol polyester is preferred because of the durability of the hydrophilic finish. Coating add-on levels to improve hydrophilic characteristics can be 0.1 to 8% of the fabric weight. The preferred add-on levels are 0.1 to 4% of the fabric weight.

For purposes of this invention, the TMA/propylene glycol (PG) polyesters demonstrating hydrophilic behavior are characterized as having acid numbers within the range from 160 to 320 and preferably 240 to 300.

While I do not wish to be bound by any theory concerning the mechanics of the TMA/propylene glycol coating process of this invention, it is theorized that the retained acidic groups of the high acid low molecular weight polyester react with the fiber surfaces by means of free hydroxyl groups on the fiber surface. The resulting hydrophilic layer of the polyester coating modifies the surface of the coated fiber to render the surface hydrophilic to reduce the deposition of oily dirt and to ease the dissipation of static charges. Inferential evidence of this reaction with the free hydroxyls present on the fiber surface is given by the high acid number of the low molecular weight polyester. The hydrophilicity of the cured finish on the fiber indicated the continued presence of the aromatic carboxyl groups.

The TMA/glycol polyester was tested as a hydrophilic, antistatic and antisoiling finish on clean, undyed fabrics obtained from Test Fabrics, Inc., Middlesex, N.J. Finish levels of 1% and 4% (solids) were tested on the weight of the goods (owg) by coating the fabric with the appropriate solution to 100% wet pick-up. The treated fabrics were subjected to a dry-cure cycle of 5 minutes at 120° C and 5 minutes at 150° C. The fabrics tested were 100% polyester. All fabrics were from spun yarns in the 70 × 72 construction range.

Increases in the hydrophilicity of polyester fiber were measured by two different tests. The first was the American Association of Textile Chemists and Colorists (AATCC) Standard Test Method 39-1971, Evaluation of Wettability. This test provides for a rapid evaluation of the wettability of a fabric by measuring the length of time that a drop of water remains upon the surface of the test fabric. A readily absorbent material wets instantly in this test, as for example a prepared cotton print cloth, or boiled and bleached linen.

The details of the test are that a drop of water is allowed to fall from a fixed height onto a taut surface of a test specimen. The time required for the specular reflection of the water to disappear is measured and recorded as wetting time. The apparatus used consists of an embroidery hoop, a buret delivering 15 to 25 drops of water per milliliter, and a stop watch. A swatch of goods to be tested is spread over the hoop. The textile is previously allowed to condition at 65 ± 2% relative humidity and at 70° ± 2° F (21° ± 1° C) for at least 4 hours before being subjected to the test. The buret is adjusted so that it delivers one drop of water at 70° ± 5° F (22° ± 3° C) approximately every 5 seconds. The buret is positioned approximately ⅜ inch (1 cm.) above the textile and the stop watch is started as the drop falls. The watch is stopped when the liquid on surface of the textile loses its specular reflective power. Readings of wetting time are made so easily and quickly that ten can be taken and averaged. The shorter the average wetting time, the more readily wettable is the textile.

The second test utilized in the evaluation of hydrophilicity improvement is a wicking behavior test used in the industry but which has not been adopted as a standard test by AATCC. In this test a 1½ inch (3.8 cm.) strip of fabric is cut in the warp direction and weighted with a glass rod weighing 2.0 grams, ¼ in. in diameter, 1½ in. in length. One end of the fabric is then immersed in a solution containing blueing and allowed to remain in the solution for a period of 45 minutes. The blueing solution is prepared by mixing 0.5–1.0% household blueing solution in water. At the end of the 45 minute period, the sample is removed from the blueing solution and the distance which the blueing solution has wicked up the fabric is measured in centimeters.

All fabric utilized in the wicking tests had been laundered 5X in a Kenmore automatic washing machine Model 600 using standard cycles of 12 minutes with detergent plus one complete cycle without detergent. The detergent was AATCC standard detergent.

The process of my invention relates to a low molecular weight high acid number polyester of a polycarboxylic acid aromatic compound having at least three carboxy groups and a glycol of up to six aliphatic carbon atoms and two hydroxyl groups. The process of my invention has two aspects. In the first aspect, the preferable glycol is neopentyl glycol, the preferable polycarboxylic acid compound is trimellitic anhydride and the preferable molecular weight is approximately 1600, the polyester containing six TMA molecules and five neopentyl glycol units. These polyesters act as warp sizes when coated onto polyester filaments. The TMA-glycol polyesters are coated onto 100% polyester filaments using a 4 to 10% resin-water solution. The coating is then dried onto the filament by an air blast or heated drying cans to function as a warp size. The preferred add-on level as a warp size is 4 to 8% of the filament weight. The warp size coating is removed from the yarn after weaving by washing the warp yarn in a 1% sodium carbonate solution at 70° C (160° F). In the second aspect, the preferable glycol is propylene glycol, the preferable polycarboxylic acid compound is trimellitic anhydride, and the preferable molecular weight is also approximately 1600, the polyester containing six TMA molecules and five propylene glycol units. These polyesters act as hydrophilic agents when coated onto polyester fabric. The TMA-glycols polyesters are coated onto 100% polyester fabric using a 0.1 to 4.0% resin-in-water solution to a complete wet-out. The fabrics are put through a standard padder and the excess coating solution squeezed from the fabric by the rubber rolls achieving a wet pickup of 100%, to double the weight of the dry untreated fabric. The wet fabrics are then dried and the low molecular weight high acid number polyester resin is cured onto the 100% polyester fabric by heat. The coating add-on levels on the fabric can range between 0.1 to 8% of the fabric weight. The preferred add-on level is 0.1 to 4% of the fabric weight. Curing of the low molecular weight polyester on the fabric by application of heat within the range from 130° to 170° C for a period ranging from 5 to 30 minutes results in a durable hydrophilic textile finish which withstands standard laundering conditions.

In order to facilitate a clear understanding of the invention, the process of coating polyester filaments to achieve a warp size and of coating polyester fiber and fabric to provide a durable hydrophilic, antistatic, antisoiling finish to polyester fibers and fabrics, the following specific embodiments are described in detail. It should be understood, however, that the detailed expositions of the application of these materials, while indicating preferred embodiments, are given by way of illustration only since various changes and modifications within the spirit and scope of the invention will become apparent to those skilled in the art from this detailed description.

EXAMPLE I

The first aspect of my invention, the filament coating process for a warp size, uses the reaction product of trimellitic anhydride (TMA) and neopentyl glycol (NPG). The low molecular weight high acid number polyester was prepared by heating the desired mole ratio of the two reactants at 360° C for a period of 2 hours.

576 Grams (3.0 moles) of trimellitic anhydride (TMA) and 260 grams (7.5 moles) of neopentyl glycol were mixed in a one-liter resin kettle equipped with heating mantle, mechanical stirrer, nitrogen sparge, thermometer and vent tube. The temperature was raised to 360° C over a period of 2 hours with mechanical stirring. The reaction mass was maintained at a temperature of 360°–420° C for a period of 2 hours. After the desired acid number of 275 was reached, the low molecular weight polymer was allowed to cool to ambient temperature (20°–25° C). It was then ground in a Henschel mixer to approximately 50 mesh.

The powder was then dissolved in concentrated ammonium hydroxide and diluted to 30% resin in water. 30 Grams of the resin were dissolved in 35 grams of concentrated ammonium hydroxide. 35 Grams of water were added to obtain 30% resin in water. 17 Grams of the 30% resin solution were diluted with 83 grams of water to obtain a 5% resin in water solution. The pH of the 30% and 5% resin was maintained above 7.3.

Low molecular weight high acid number polyester resins were prepared with the same procedure with other glycols, propylene glycol (PG), dipropylene glycol (DPG), ethylene glycol (EG), diethylene glycol (DEG) and neopentyl glycol (NPG) 1,3-propanediol (1,3-PPD) and 1,4-butanediol (1,4-BTD) in mole ratios of 1.0/1.4 to 1.3/1.0. The composition mole ratio, weight in grams and acid numbers are in Table I.

Table I

| Warp Size Polyester Resins | | | |
|---|---|---|---|
| Composition | Mole Ratio | Wgt In Grams | Acid Number |
| TMA/PG | 1.0/1.4 | 960/420 | 247 |
| TMA/PG | 1.0/1.2 | 960/360 | 353 |
| TMA/PG | 1.0/1.0 | 960/300 | 260 |
| TMA/PG | 1.2/1.0 | 1152/300 | 258 |
| TMA/PG | 1.2/1.0 | 1152/300 | 274 |
| TMA/PG | 1.3/1.0 | 1248/300 | 288 |
| TMA/DPG | 1.2/1.0 | 1252/670 | 275 |
| TMA/DEG | 1.2/1.0 | 1152/530 | 271 |
| TMA/EG | 1.2/1.0 | 1152/310 | 243 |
| TMA/NPG | 1.2/1.0 | 1152/520 | 261 |
| TMA/NPG | 1.0/1.0 | 960/520 | 221 |
| TMA/NPG | 1.1/1.0 | 1056/520 | 292 |
| TMA/NPG | 1.3/1.0 | 1248/520 | 256 |
| TMA/1,3-PPD | 1.2/1.0 | — | 255 |
| TMA/1,4-BTD | 1.2/1.0 | — | 286 |

EXAMPLE II

The resins of Example I were tested for hardness, flexibility and adhesion to polyester film as polyester filament warp sizes.

Films of the 30 and 5% solutions of the ammonium salts of the resins were cast upon 1 and 5 mil polyethylene terephthalate films, 200 centimeters square. Each test sample was prepared by puddling 2 grams (2 ml) of the 30 and 5% solutions upon the polyester film substrate. Two samples of each solution were prepared.

Drying of the samples was allowed to take place overnight at 50% RH and room temperature, 20°–25° C. The tack of the air-dried film was tested first by touch using an acetone-washed finger to discern any evidence of tack. The acetone removed any skin oil which would have influenced the feeling of tackiness. The cast films on polyethylene terephthalate films were then conditioned in a humidity chamber for 18–24 hours at 55% relative humidity (RH). The conditioned films were then tested again for tack by touch, using an acetone-washed finger. The conditioned films were then placed face to face, cast film against cast film, under a 200 gram weight for two hours. The samples were then separated to determine any sticking (or tack) between the cast films.

The cast films were tested for adhesion to the polyester film substrate by creasing the cast film samples. Three 180° bends were made so that the cast film was creased against itself 3 times. The creases were then opened and the cast films examined for cracking and/or peeling from the polyester film substrate. After the visual examination, the cast films were then severely crumpled with a harsh grinding motion for a period of several seconds until the cast films and polyester substrate resembled a badly crushed sheet of paper. A visual examination was again made to determine if any cracking and/or peeling had occurred.

Removeability of the resin from the substrate was measured on an over-dried sample. An air-dried sample was further dried in a forced air oven at a temperature of 120° C for a period of 10 minutes. The oven-dried resin/polyester film sample was immersed in a stirred 1% sodium bicarbonate solution maintained at 70° C (160° F). Removal of the test resin film was required to be complete after 1 minute.

The cast film samples on polyester terephthalate film were conditioned in a humidity chamber for 18–24 hours at 75% RH and the tack and adhesion tests made again. The tests for tack were made by touch, using an oil-free finger, and by placing two humidity-conditioned films face-to-face. The increased humidity increased the tack of all cast films. However, the TMA/NPG resin in the mole ratio of 1.2/1.0 showed the least increase in tack and maintained excellent adhesion. The results are shown in Table II.

Table II

| Warp Size Polyester Resins Mole Ratio/Tack/Adhesion | | | |
|---|---|---|---|
| Composition | Mole Ratio | Tack 55% RH/75% RH | Adhesion |
| TMA/PG | 1.0/1.4 | High/High | Excellent |
| TMA/PG | 1.0/1.2 | High/High | Excellent |
| TMA/PG | 1.0/1.0 | High/High | Excellent |
| TMA/PG | 1.2/1.0 | Low/Moderate | Excellent |
| TMA/PG | 1.2/1.0 | Low/Moderate | Excellent |
| TMA/PG | 1.3/1.0 | High/High | Moderate |
| TMA/DPG | 1.2/1.0 | High/High | Excellent |
| TMA/DEG | 1.2/1.0 | High/High | Excellent |
| TMA/EG | 1.2/1.0 | High/High | Excellent |
| TMA/NPG | 1.2/1.0 | None/Very Low | Excellent-Some crazing |
| TMA/NPG | 1.0/1.0 | High/High | Excellent |
| TMA/NPG | 1.1/1.0 | High/High | Good |
| TMA/NPG | 1.3/1.0 | High/High | Good-Some Crazing |
| TMA/1,3-PPD | 1.2/1.0 | High/High | Excellent |
| TMA/1,4-BTD | 1.2/1.0 | High/High | Excellent |

EXAMPLE III

The reaction product of trimellitic anhydride (TMA) and propylene glycol (PG) was prepared by heating the desired mole ratio of the two reactants at 180° C (360° F) for a period of 2 hours. Specifically, 576 grams (3.0 moles) of trimellitic anhydride (TMA) and 190 grams (2.5 moles) of propylene glycol (PG) were mixed in a one-liter resin kettle equipped with heating mantle, mechanical stirrer, nitrogen sparge, thermometer and vent tube. The temperature was raised to 180° C (360° F) over a period of 2 hours with mechanical stirring. The reaction mass was maintained at a temperature of 180°–200° C for a period of 2 hours. The product was then cooled and stored. The final product was a thick paste heavier in viscosity than the liquid propylene glycol used as a reactant.

The 1% coating or finishing bath solution was prepared by measuring into a tared beaker containing a magnetic stirring bar 3 grams of the TMA/PG polyester and 297 grams of deionized or distilled water.

EXAMPLE IV

The improvement in wettability characteristics of 100% polyester fabric by the process of coating onto the fabric the high acid number low molecular weight polyester of TMA/PG is exemplified in the following example. The wettability test used was the AATCC test method 39–1971, Evaluation of Wettability.

The TMA/PG polyester was prepared according to the procedure given in Example III. A 1% level of add-on was used.

The same swatches were prepared in the following method. The pieces of spun woven 100% polyester fabric, 15 × 15 in. (38 × 38 cm) were weighed to the nearest 100th gram. The fabrics were then submerged in the 1% finishing bath which is described above. After insuring that a complete wetout had occurred, the fabrics were then put through a standard padder (consisting of two rubber rolls) and the excess pad solution squeezed from the fabrics. Normally a wet pickup of 100% was achieved of the 1% active finishing bath. After padding, the wet fabrics were stretched over tenter frames and placed in a drying oven at 120° C for a period of 5 minutes. The dried fabrics were then cured for an additional 5 minutes at 150° C.

The wettability test was run on swatches of 100% polyester fabric which had been finished according to the treating process utilizing the 1% finishing bath, dried for 5 minutes and cured for 5 minutes. The sample swatches were then subjected to five standard wash cycles of 12 minutes each with AATCC standard detergent. One total rinse, a wash cycle without use of detergent, followed the 5 washes. The swatches were dried in a Kenmore Model 600 dryer.

Each test swatch was conditioned for 4 hours in a humidity oven at 65 ± 2% relative humidity and 70° ± 2° F (21° ± 1° C) and then mounted in an embroidery hoop located beneath a buret. Distilled water was in the buret, temperature 70° ± 5° F (21° ± 3° C). The buret was positioned approximately ⅝ inch (1 cm) above the textile swatch. The buret was adjusted to deliver one drop of water approximately every 5 seconds. Each swatch in the hoop was moved to different positions under the buret so as to receive 5 drops of water in five different locations. The stop watch was started just as each drop began to fall. The watch was stopped when the liquid on the surface of the swatch lost its specular reflective power. The average time for the 5 drops of the TMA/PG sample is set forth in Table III.

Table III

| Evaluation of Wettability - 100% Polyester Fabric AATCC Test 39-1971 | | |
|---|---|---|
| Sample | % Active Coated | Time to Disappear In Seconds - Avg. Of Five Readings |
| Control | (No Coating) | 1500 |
| 1.2/1.0 TMA/PG (250 A.N.) | 1% | 233.4* |

*After 5 standard AATCC laundry cycles

EXAMPLE V

Swatches of 100% polyester fabric were prepared as in Example II and were subjected to a wicking behavior test. Each swatch was ten inches long and cut in the warp direction of the fabric at a width of 1 ½ inches (3.8 cm). A loop was sewn in one end of each strip of fabric large enough so that a 1½ inch rod ¼ inch in diameter weight 2.0 grams could be inserted. Each piece of fabric was then suspended from a rod and immersed to a depth of one inch above the thread line of the loop in a solution of distilled water and 1.0% household blueing, which was added to aid in detection of the wicking level. Each swatch of fabric was allowed to remain in the blueing solution for 45 minutes. At the end of this period, the swatch was removed from the solution and the level to which the water had wicked up the fabric was measured in centimeters. The higher the wicking level, the greater the hydrophilicity of the fabric finish. The wicking results are set forth in Table IV.

Table IV

Evaluation of Wicking - 100% Polyester Fiber

| Sample | % Active Coated | Wicking Height In 45 Minutes - Centimeters |
|---|---|---|
| Control | (No Coating) | 6.1 |
| Control | (No Coating) | 6.0 |
| Control | (No Coating) | 6.2 |
| 1.2/1.0 TMA/PG (250 A.N.) | 1% | 11.3* |

*After 5 standard AATCC laundry cycles.

What is claimed is:

1. A process of warp sizing textile filaments which comprises the steps of (1) coating said textile filament with an aqueous solution of a water-soluble polyester reaction product consisting essentially of a dihydric alcohol having two to six carbon atoms and an aromatic polycarboxylic acid compound having three, four or five carboxy groups and (2) drying said polyester on said textile filaments, the said alcohol and said acid compound being reacted in a mole ratio where the ratio of acid to alcohol is greater than unity, wherein the acid number of said reaction product is within the range of from 160 to 320 grams of KOH per gram of said product.

2. The process of claim 1 wherein said dihydric alcohol comprises neopentyl glycol.

3. The process of claim 1 wherein said polycarboxylic acid compound comprises trimellitic anhydride.

4. The process of claim 1 wherein said textile filaments are polyester filaments.

5. A process of treating textile fabrics which comprises the steps of (1) coating said textile fabrics with an aqueous solution of a water-soluble polyester reaction product consisting essentially of a dihydric alcohol having two to six carbon atoms, and an aromatic polycarboxylic acid compound having three, four or five carboxy groups and (2) curing said polyester on said textile fabrics, the said alcohol and said acid compound being reacted in a mole ratio where the ratio of acid to alcohol is greater than unity, wherein the acid number of said reaction product is within the range from 160 to 320 grams of KOH per gram of said product.

6. The process of claim 5 wherein said dihydric alcohol comprises propylene glycol.

7. The process of claim 5 wherein said polycarboxylic acid compound comprises trimellitic anhydride.

8. The process of claim 5 wherein said textile fabrics are polyester fabrics.

9. The process of claim 1 wherein the said ratio of acid to alcohol is 1.2:1.

10. The process of claim 5 wherein the said ratio of acid to alcohol is 1.2:1.

* * * * *

UNITED STATES PATENT OFFICE

CERTIFICATE OF CORRECTION

Patent No. 4,035,531 Dated July 12, 1977

Inventor(s) John C. Lark

It is certified that error appears in the above-identified patent and that said Letters Patent are hereby corrected as shown below:

Col. 1, line 42 reads "size" should read --sizes--

Col. 2, line 39 reads "molecular coating" should read --molecular weight coating--

Col. 10, line 48 reads "5/8 inch" should read --3/8 inch--

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*